United States Patent [19]

Erckel et al.

[11] Patent Number: 4,589,924

[45] Date of Patent: May 20, 1986

[54] PROCESS FOR HYDROLYZING CELLULOSE-CONTAINING MATERIAL WITH GASEOUS HYDROGEN FLUORIDE

[75] Inventors: Rüdiger Erckel, Eppstein; Raimund Franz, Kelkheim; Rolf Woernle, Bad Soden am Taunus; Theodor Riehm, Heidelberg, all of Fed. Rep. of Germany

[73] Assignee: Hoechst Aktiengesellschaft, Fed. Rep. of Germany

[21] Appl. No.: 710,520

[22] Filed: Mar. 12, 1985

Related U.S. Application Data

[63] Continuation of Ser. No. 434,581, Oct. 15, 1982, abandoned.

[30] Foreign Application Priority Data

Oct. 24, 1981 [DE] Fed. Rep. of Germany ..... 3142216

[51] Int. Cl.[4] ..... C13K 1/02

[52] U.S. Cl. ..... 127/37; 162/14; 162/63

[58] Field of Search ..... 137/2, 37; 162/19, 47, 162/62, 66, 241, 248, 249, 34, 35, 42, 67, 88, 89, 14, 15, 16, 63

[56] References Cited

U.S. PATENT DOCUMENTS

| | | | |
|---|---|---|---|
| 3,481,827 | 12/1969 | Brooks | 162/63 |
| 3,619,350 | 11/1971 | Marchfelder | 162/67 |
| 3,919,041 | 11/1975 | Wilder | 162/89 |

FOREIGN PATENT DOCUMENTS

| | | |
|---|---|---|
| 51237 | 10/1981 | European Pat. Off. . |
| 577764 | 6/1981 | Fed. Rep. of Germany . |
| 585318 | 10/1983 | Fed. Rep. of Germany . |

OTHER PUBLICATIONS

Seike et al., Industrial and Engineering Chem. Prod. Res. Dev., 21:11-16 (1982).

Chemical Abstracts, 96:202455v (1982).

Hardt et al., in Biotechnology and Bioengineering, John Wiley & Sons, N.Y., 1982, pp. 903-918.

Fredenhugen et al., "Breakdown of Cellulose by Hydrogen Fluoride . . . ", Angewardte Chemie, Feb. 1933, vol. 46, 7, pp. 113-124.

Kirk-Othmer Encyclopedia of Chemical Technology, 2nd Ed., vol. 22, Wiley-Interscience, 1970, pp. 383-384; 3rd Ed., vol. 4, 1978, p. 547; vol. 11, 1980, pp. 348-349, 362, 363.

The Condensed Chemical Dictionary, 6th Ed., Reinhold, N.Y. 1961, p. 590.

Concise Chemical & Technical Dictionary, Chem. Pub. Co., 1974, p. 558.

*Primary Examiner*—Steve Alvo

*Attorney, Agent, or Firm*—Connolly and Hutz

[57] ABSTRACT

The semi-continuous process according to the invention for hydrolyzing cellulose-containing material (substrate) with gaseous hydrogen fluoride comprises sorption and subsequent desorption of HF in a total of n steps. The substrate is divided into n batches in n reactors (1*a*, 1*b*, 1*c*, . . . ); each batch passes through the n process steps in one reactor (1*a*, . . . ). Initially, sorption is carried out in the first to the (n/2)th step by the action of HF-inert gas mixtures, having an HF concentration which increases from sorption step to sorption step, at a temperature above the boiling point of HF. Subsequently, desorption is brought about in the ((n/2)+1)th to nth step by treating with heated HF-inert gas mixtures having an HF concentration which decreases from desorption step to desorption step; n is an even number from 4 to 12 and the n steps each take place in the same time segments (periods). The sequence of steps is displaced by one period from each batch to the next batch. During each period, the batch in the first step is connected to the batch in the last step and the batch in the second step with the batch in the penultimate step and the batch in the (n/2)th step with the batch in the ((n/2)+1)th step, by HF-inert gas circulations.

6 Claims, 5 Drawing Figures

PROCESS FOR HYDROLYZING CELLULOSE-CONTAINING MATERIAL WITH GASEOUS HYDROGEN FLUORIDE

It is known that cellulose-containing material, for example wood or waste from annual plants, can be chemically digested with mineral acids. During this, the cellulose contained therein, which is a macromolecular material, is decomposed, with cleavage of glycosidic bonds, into smaller, water-soluble molecules, as far as the monomer units, the glucose molecules. The sugars thus obtained can, inter alia, be fermented to produce alcohol or used as a raw material for fermentation to produce proteins. This gives rise to the industrial importance of the hydrolysis of wood. Mineral acids which are suitable for this purpose and which were already employed on a large scale decades ago are dilute sulfuric acid (Scholler process) and concentrated hydrochloric acid (Bergius process); in this context, see, for example, Ullmanns Encyklopädie der technischen Chemie (Ullmann's Encyclopedia of Industrial Chemistry), 3rd edition, Munich-Berlin, 1957, volume 8, pages 591 et seq.

It is also known that hydrogen fluoride can be used for the hydrolysis of wood. Its boiling point (19.7° C.) makes it possible to bring it into contact with the substrate to be digested without water as a solvent and to recover it after digestion is complete with comparatively little expense. In this instance, suitable substrates for digestion are not only untreated material, on the contrary, it has also already been suggested that waste paper or lignocellulose, which is the residue from preliminary hydrolysis, should be used instead, and this still contains only very little hemicelluloses and other accompanying substances from wood and is composed almost exclusively of cellulose and lignin. Not only wood but also paper or residues of annual plants of all types, such as straw or bagasse, can be subjected to this preliminary hydrolysis. According to the state of the art, it comprises exposure to water or dilute mineral acid (about 0.5% strength) at 130° to 150° C. (cf. for example the handbook "Die Hefen" ("Yeasts") volume II, Nuremberg, 1962, pages 114 et seq.) or to saturated steam at 160° to 230° C. (cf. U.S. Pat. No. 4,160,695).

For the reaction of hydrogen fluoride with cellulose-containing material, three industrial process principles are known from the literature:

reaction with gaseous hydrogen fluoride under atmospheric pressure, extraction with liquid hydrogen fluoride, and finally reaction with gaseous hydrogen fluoride in vacuo.

In German Pat. No. 585,318, a process and a device for treating wood with gaseous hydrogen fluoride are described in which, in a first zone of a reaction tube having a conveying screw, hydrogen fluoride gas, which can be diluted with an inert gas, is brought to reaction with wood by this zone being cooled from outside to below the boiling point of hydrogen fluoride. After digestion, which can optionally take place in an intermediate zone, according to this process the hydrogen fluoride is driven off by external heating and/or blowing out with a stream of inert gas, in order to be brought into contact again with fresh wood in the cool zone mentioned.

In practice, however, carrying out this process is difficult. When the hydrogen fluoride condenses on the substrate, it only distributes non-uniformly, so that overheating occurs in places. This is clear, for example, from German Pat. No. 606,009, in which is stated: "It has emerged that on merely moistening the polysaccharides, for example the wood, with hydrofluoric acid or on charging the wood and the like with hydrofluoric acid vapors, increases in temperature can occur which lead to partial decomposition of the conversion products formed. However, removal of this heat by cooling is difficult due to the poor thermal conductivity of the cellulose-containing material." The remedy described in this patent is extraction with liquid hydrogen fluoride, but this requires large amounts of hydrogen fluoride and is associated with the disadvantage that, in order to vaporize the hydrogen fluoride from the extract and from the extraction residue (lignin), large amounts of heat must be supplied and these must be removed again during the subsequent condensation.

Austrian Pat. No. 147,494, which was published a few years later, analyzes the two processes mentioned. The remedy described in this patent to counteract the non-uniform and incomplete degradation of the wood on digestion with highly concentrated or anhydrous hydrofluoric acid in the liquid or gaseous state at low temperatures, and to counteract the disadvantages of the high excess of hydrofluoric acid in the extraction process is an industrially elaborate process in which the wood is evacuated as far as possible before exposure to hydrogen fluoride and the recovery of the hydrogen fluoride is also carried out in vacuo. The process is also described in the journal "Holz, Roh- und Werkstoff" 1 (1938) 342–344. The high industrial cost of this process is not only due to the vacuum techniques themselves, but also due to the circumstance that the boiling point of hydrogen fluoride is already less than −20° C. at 150 mbar; this means that, without the assistance of expensive coolants or cooling units, condensation is no longer possible.

The state of the art of digesting wood with hydrogen fluoride known from the literature is characterized by the three processes or devices described. Accordingly, none of these methods or devices combines low cost and good results of digestion in a manner which is industrially satisfactory. The method of reacting, which is in itself economical, cellulose-containing material with a mixture of hydrogen fluoride and an inert gas, which originates from hydrogen fluoride desorption, according to German Pat. No. 585,318, which has already been mentioned above, is, according to the more recently published German Pat. No. 606,009, apparently adversely affected by the necessity of cooling below the boiling point of hydrogen fluoride during the absorption.

Surprisingly, it has now been found that gaseous hydrogen fluoride mixed with an inert carrier gas can be recycled almost without loss while producing a concentration on the substrate which is necessary for good yields, without it being necessary in this process to cool below the boiling point of hydrogen fluoride, which is highly disadvantageous industrially. This is achieved by dividing the total time necessary for sorption and desorption of hydrogen fluoride into several segments (periods) in which, corresponding to the HF concentration on the substrate, which differs in each case, gas mixtures of different concentrations pass through the latter, so that it is possible, during sorption, to allow gas mixtures of low HF concentration to act on material having a low or zero concentration of HF and mixtures of higher HF concentration to act on material already having a higher concentration of HF.

This measure was not obvious. On the contrary, statements in the literature lead to the conclusion that an adequate concentration on wood material is not possible above the boiling point of hydrogen fluoride, even when the latter is undiluted. In a report by Fredenhagen and Cadenbach, Angew. Chem. 46 (1933) 113/7, it is said (page 115 bottom right-hand side to page 116 top left-hand side): "When gaseous HF is allowed to act on wood at room temperature HF is absorbed and, as a result, the temperature rises. However, this means that no more HF is absorbed, so that the reaction comes to a standstill and no further increase in temperature occurs." Thus it was all the more surprising to find that hydrogen fluoride sorption is largely independent of the heat of reaction, which only makes itself noticeable up to relatively low concentrations, and, on the contrary, at a given temperature, the sorption only depends on the HF concentration in the gas mixture acting, i.e. it can also be carried out at temperatures above the boiling point of hydrogen fluoride up to the concentration levels necessary for good yields by stepwise production and use of streams having different HF concentrations.

Thus, the invention relates to a semi-continuous process for digesting cellulose-containing material (substrate) with gaseous hydrogen fluoride by sorption of HF and subsequent desorption, which comprises for n batches of the substrate carrying out, in each case in one of n reactors which are independent of one another in respect of the substrate, in each case in n steps, initially sorption in the first to (n/2)th step, by the action of HF-inert gas mixtures flowing through the substrate having HF concentrations which increase from sorption step to sorption step at a temperature above the boiling point of HF and then desorption in the ((n/2)+1)th to nth step, by treatment with heated HF-inert gas mixtures passing through the substrate and having HF concentrations which decrease from desorption step to desorption step, wherein n is an even number from 4 to 12, preferably from 4 to 8, and wherein the n steps each take place in identical segments of time (periods) and wherein the sequence of steps from batch to batch is each displaced by one period and wherein, during each period, the batch in the first step in each case is connected with the batch in the last (nth) step and the batch in the second step is connected with the batch in the penultimate (n−1)th step and . . . the batch in the (n/2)th step with the batch in the ((n/2)+1)th step, in each case by an HF-inert gas circulation.

Suitable reactors are, amongst others, stirred vessels, rotating cylinders, loop reactors, reaction contact equipment and fluidized bed reactors having the fluidized bed produced pneumatically or mechanically, for example differential screw mixers. These reactors can optionally be provided with a heat-exchanging device for heating and cooling.

The cellulose-containing material which can be employed is wood or waste from annual plants (for example straw or bagasse) or, preferably, a preliminary hydrolyzate of wood or wastes from annual plants, or, equally preferably, waste paper.

It is known that the presence of a certain amount of water is necessary for digestion of celluloses, which is, of course, a hydrolytic cleavage. This water can either by introduced by being present in the substrate as residual moisture of 0.5 to 20, preferably 1 to 10, in particular 3 to 7%, by weight or by being contained in the mixture of HF and inert gas, or in both.

Suitable inert carrier gases (inert gases) are air, nitrogen, carbon dioxide or one of the inert gases, preferably air or nitrogen.

The substrate temperatures selected for desorption are in the range from 40° to 120° C., preferably from 50° to 90° C., it being possible for the temperatures for the individual desorption steps to be different, whilst the temperature selected for the relevant sorption in each case is in the range from 20° to 50° C., preferably 30° to 45° C.

During one period, two reactors each are connected together by gas pipes to form reactor systems as follows: A reactor freshly charged with substrate, in which the first sorption step takes place, with a reactor in which the last (nth) step, i.e. the (n/2)th desorption step takes place, a reactor in which the second sorption step takes place, with a reactor in which the penultimate (n−1)th step (=((n/2)−1)th desorption step) takes place, . . . and finally a reactor in which the last ((n/2)th) sorption step takes place with a reactor in which the first desorption step (=((n/2)+1)th step) takes place.

The reactor in which the last desorption step takes place contains, at the end of the period, digested substrate which only has small amounts of residual HF. The reactor is emptied during the last and relatively short part of the period and filled with fresh substrate. The gas circulation is interrupted during this. Filling with fresh substrate can also be carried out, preferably, at the start of the next period. Obviously, it is also possible to provide a special period for emptying and refilling a reactor. During this period, the reactor is not connected with any other reactor. The number of reactors in this case is n+1. The first sorption step takes place in the reactor filled with fresh substrate during the next period. It is now connected by gas pipes to the reactor in which the last desorption step is now taking place and in which the penultimate desorption step took place during the previous period. The second sorption step now takes place in the reactor in which the first sorption step took place during the previous period. It is connected by gas pipes to the reactor in which the penultimate ((n/2)−1)th) desorption step now takes place and in which the pre-penultimate ((n/2)−2)th) desorption step took place during the previous period and so on, and so on.

The gas in the particular reactor systems is passed according to the invention in such a manner that, in each case, the gas outlet of the reactor functioning as a sorption reactor is connected by gas pipes with the gas inlet of the reactor functioning as a desorption reactor and the gas outlets of the latter are connected by gas pipes with the gas inlet of the former. In addition, a gas pump and a heat-exchanger are inserted upstream of the gas inlet of the desorption reactor.

If appropriate, heat-exchangers can also be arranged upstream of the gas inlet of the reactors functioning as sorption reactors. They have, where appropriate, the task of bringing the gas mixture destined for sorption in each case to the optimum temperature for this purpose, generally by cooling. In certain circumstances, they have the additional task of condensing out any substances accompanying the material employed, which have been liberated during desorption, such as water, acetic acid and ethereal oils, but of allowing hydrogen fluoride in the form of a gas to pass through.

In each reactor system, an HF-carrier gas stream is circulated by means of a gas pump (blower). In the sorption reactor, the gas mixture loses HF, and is heated up to the temperature necessary for desorption in the heat-exchanger, which is arranged upstream of the desorption reactor. In the desorption reactor, the gas mixture is enriched with HF by the HF liberated during desorption and is conveyed again to the sorption reactor.

The HF concentration in the HF-carrier gas stream in the first reactor system is relatively low before entry into the sorption reactor. In the first sorption reactor, it acts on the substrate which as yet contains no HF. In the second and in the following reactor systems, the HF concentration in the HF-carrier gas stream must be higher, since the substrate to be treated in the particular sorption reactor has an increasing concentration of HF.

The optimum dwell time, i.e. the time a substrate batch stays in one of the reactors (=n times the period) from the start of sorption to the end of desorption depends on the nature, characteristics and amount of the material to be digested, on the type of reactor and on the number n of steps and must be adjusted to suit the particular case.

The maximum concentration of HF on the cellulose-containing material of a batch at the end of sorption, i.e. at the end of the (n/2)th step, equally depends on the nature, characteristics and amount of the material to be digested and on the type of reactor and on the dwell-time in the (n/2) sorption steps (=n/2) times the period). It is in the range from 10 to 120% by weight, preferably 30 to 80% by weight, relative to the weight of the material employed.

The HF concentration in the HF-inert gas mixture entering the last sorption step is up to more than 95% by weight. On leaving the reactor in which this last sorption step takes place, the HF concentration can still be up to 80% by weight. On leaving the reactor in which the first sorption step takes place, the gas stream is (almost) free of HF.

The invention is to be illustrated in more detail by means of FIGS. 1 to 5.

Figure 1:
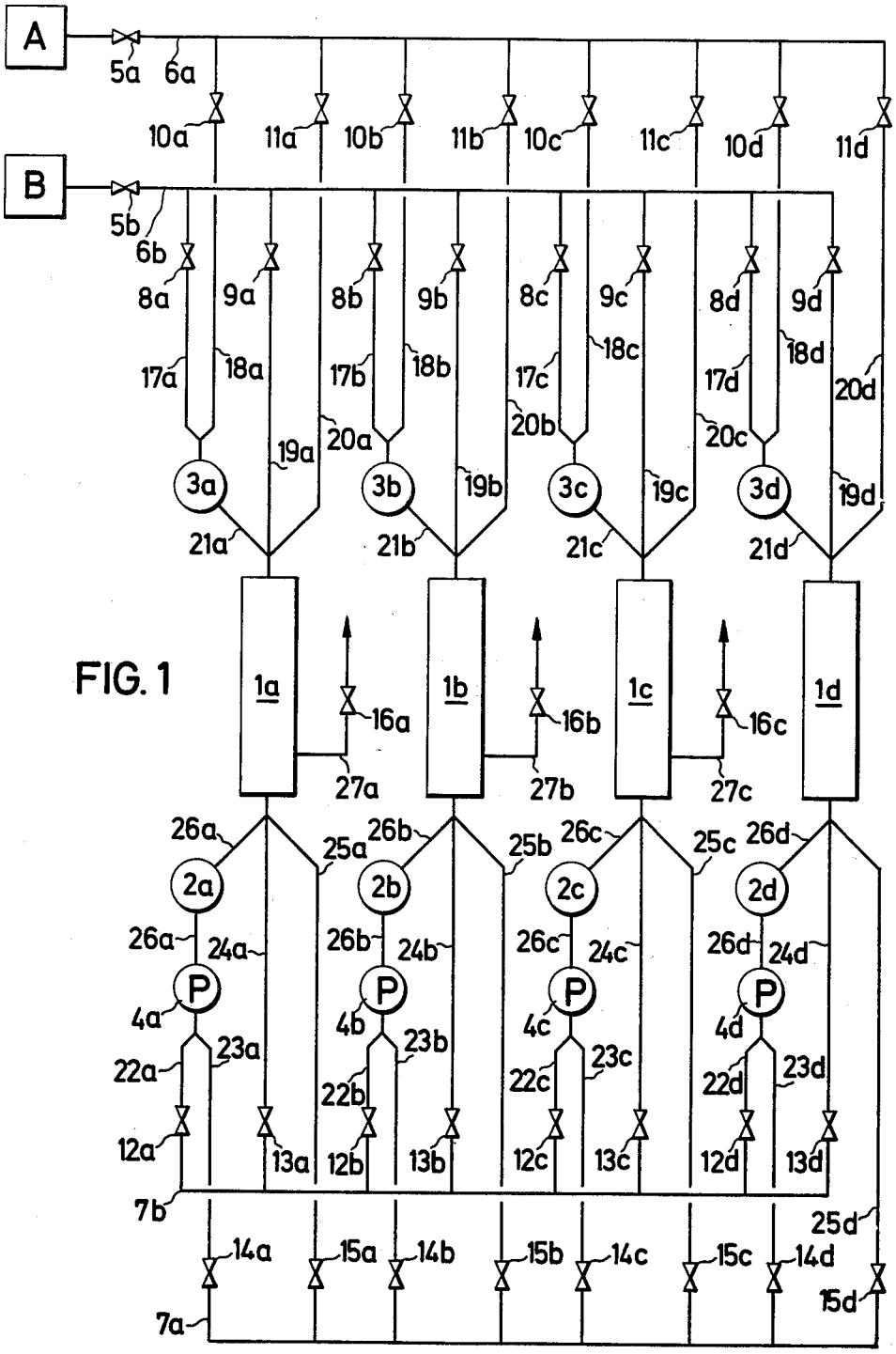
FIG. 1 shows the overall plan of a plant with 4 reactors

In these figures, the following numbers represent the following items:

1*a, b, c, d* reactors
2*a, b, c, d* heat-exchangers (heaters)
3*a, b, c, d* heat-exchangers (coolers)
4*a, b, c, d* gas pumps (blowers)
5*a, b* valves (taps)
6*a, b* gas pipes
7*a, b* gas pipes
8*a, b, c, d* valves (taps) in gas pipes 17*a, b, c, d*
9*a, b, c, d* valves (taps) in gas pipes 19*a, b, c, d*
10*a, b, c, d* valves (taps) in gas pipes 18*a, b, c, d*
11*a, b, c, d* valves (taps) in gas pipes 20*a, b, c, d*
12*a, b, c, d* valves (taps) in gas pipes 22*a, b, c, d*
13*a, b, c, d* valves (taps) in gas pipes 24*a, b, c, d*
14*a, b, c, d* valves (taps) in gas pipes 23*a, b, c, d*
15*a, b, c, d* valves (taps) in gas pipes 25*a, b, c, d*
16*a, b, c, d* valves (taps) in gas pipes 27*a, b, c*
17*a, b, c, d* gas pipes from gas pipe 6*b* via valves 8*a, b, c, d* to heat-exchangers 3*a, b, c, d*
18*a, b, c, d* gas pipes from gas pipe 6*a* via valves 10*a, b, c, d* to heat-exchangers 3*a, b, c, d*
19*a, b, c, d* gas pipes from gas pipe 6*b* via valves 9*a, b, c, d* to reactors 1*a, b, c, d*
20*a, b, c, d* gas pipes from gas pipe 6*a* via valves 11*a, b, c, d* to reactors 1*a, b, c, d*
21*a, b, c, d* gas pipes from heat-exchangers 3*a, b, c, d* to reactors 1*a, b, c, d*
22*a, b, c, d* gas pipes from gas pipe 7*b* via valves 12*a, b, c, d* to pumps 4*a, b, c, d*
23*a, b, c, d* gas pipes from gas pipe 7*a* via valves 14*a, b, c, d* to pumps 4*a, b, c, d*
24*a, b, c, d* gas pipes from gas pipe 7*b* via valves 13*a, b, c, d* to reactors 1*a, b, c, d*
25*a, b, c, d* gas pipes from gas pipe 7*a* via valves 15*a, b, c, d* to reactors 1*a, b, c, d*
26*a, b, c, d* gas pipes from pumps 4*a, b, c, d* via heat-exchangers 2*a, b, c, d* to reactors 1*a, b, c, d*
27*a, b, c* waste gas pipes with valves 16*a, b, c*
A, B mixers for producing the HF-inert gas mixture.

For reasons of improved clarity, in FIGS. 2 to 5, only the reactors, heat-exchangers, pumps, opened valves and gas pipes connected together in the relevant period are drawn.

The waste gas pipes 27*a, b, c* with the valves 16*a, b, c* are only required for starting up the plant during the first three periods. Equally, the valves 5*a* and 5*b* are only opened during the first three periods when starting up, in order to convey HF-inert gas mixture to the reactors charged with substrate, since this is not yet available by desorption of another batch of substrate.

The HF-inert gas mixtures from the mixers A and B are fed into the gas pipes 6*a* and 6*b* through the valves 5*a* and 5*b* and, depending on the opening of the valves, passed into reactors 1*a, b, c.* The mixture coming from mixer B has a higher concentration than that coming from mixer A.

In the first starting up period, gas mixture from mixer A is introduced through the opened valve 10*a,* if necessary after cooling in heat-exchanger 3*a,* into reactor 1. HF is sorbed by the substrate here and the waste gas leaves the reactor through the waste gas pipe 27*a* when valve 16*a* is open. After completion of the first period, the valve 10*a* is closed and the valves 8*a* and 10*b* are opened.

In the second starting up period, the gas mixture with the lower HF concentration now flows into reactor 1*b,* while the gas mixture of higher HF concentration coming from mixer B flows into reactor 1*a.* The second sorption step takes place in reactor 1*a* and the first sorption step takes place in reactor 1*b.* After completion of the second period, the sorption of HF by the substrate in reactor 1*a* is complete. The valves 5*b,* 8*a* and 10 *b* are closed, the valves 10*c,* 9*a,* 8*b,* 12*a* and 13*b* are opened and the gas pump 4*a* is switched on.

In the third starting up period, the gas mixture with the lower HF concentration now flows into reactor 1*c,* in which the first sorption step takes place, while the first desorption step and the second sorption step take place in reactors 1*a* and 1*b* respectively. The gas pump 4*a* circulates a gas stream as shown schematically in the left-hand half of FIG. 4: the gas stream is heated up in heat-exchanger 2*a.* Desorption of HF occurs in reactor 1*a* due to the action of the hot gas stream on the substrate containing HF. The gas stream enriched with the desorbed HF is introduced through the gas pipes 19*a*, 6*b*, 17*b*, the heat-exchanger 3*b*, in which it is cooled if necessary, and the gas pipe 21*b* into reactor 1*b*. HF is sorbed by the substrate in the second step here. The gas stream depleted of HF is again conveyed to gas pump 4*a* through gas pipes 24*b*, 7*b* and 22*a* and so on. After completion of the third period, valves 5*a*, 10*c*, 9*a*, 8*b*, 12*a* and 13*b* are closed, valves 11*a*, 10*d*, 14*a*, 15*d*, 9*b*, 8*c*, 12*b* and 13*c* are opened and gas pump 4*b* is switched on.

Figure 5:
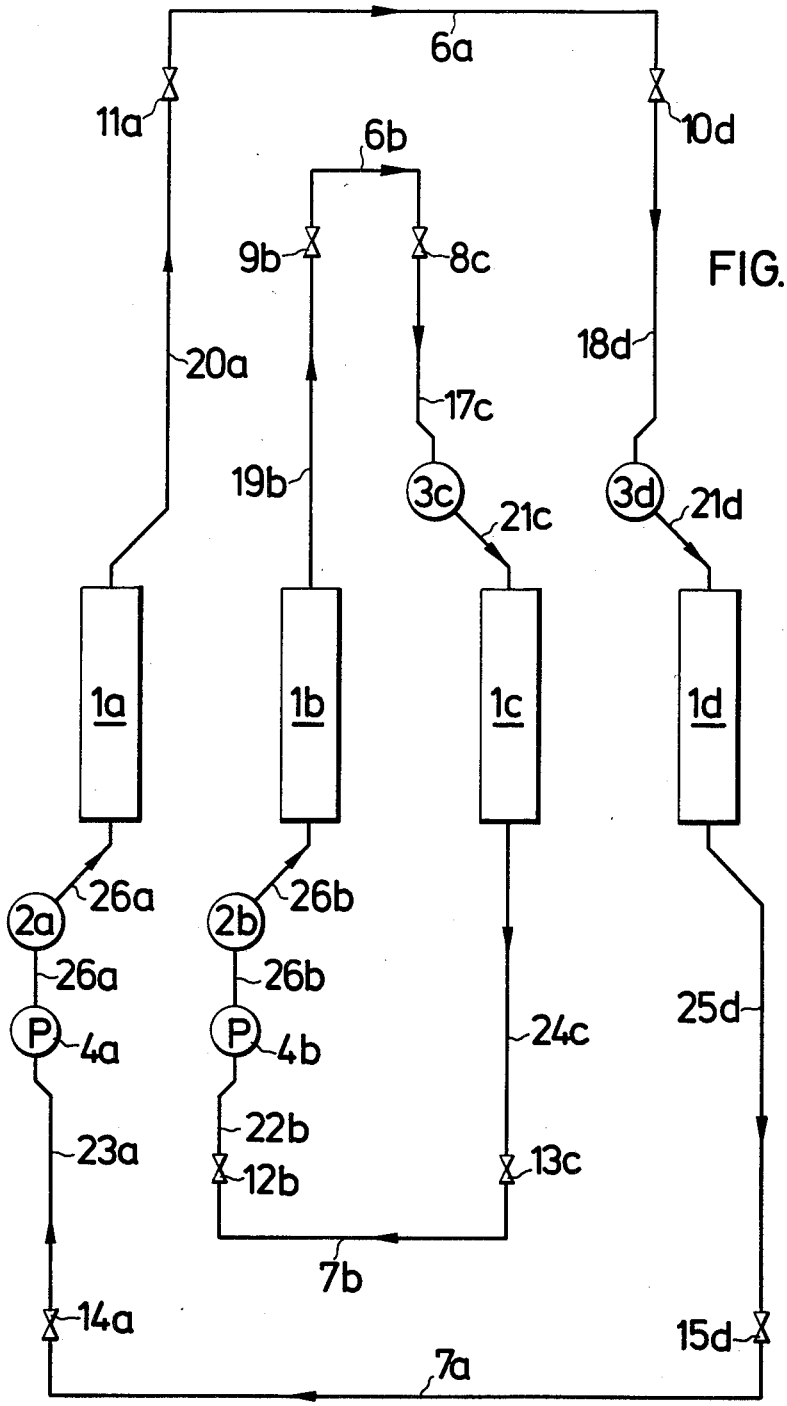
FIG. 5 shows the flow diagram in period 4 for the plan of FIG. 1.

In the fourth starting up period, two gas streams are now circulated by gas pumps 4*a* and 4*b*, as is shown schematically in FIG. 5.

In one gas circulation, more HF is liberated by desorption (in the second desorption step) in reactor 1*a* as a result of the action of the gas stream heated up in heat-exchanger 2*a*. The gas stream enriched with the desorbed HF—the HF concentration is now lower than in the gas stream leaving reactor 1*a* in the previous period in the first desorption step—is introduced through the gas pipes 20*a*, 6*a*, 18*d*, the heat-exchanger 3*d*, in which it is cooled if necessary, and the gas pipe 21*d* into reactor 1*d*. The HF is sorbed by the substrate in the first step here. The gas stream which is largely freed of HF is conveyed again to gas pump 4*a* through gas pipes 25*d*, 7*a* and 23*a* and so on.

In the other gas circulation, HF is liberated by desorption (in the first desorption step) in reactor 1*b* as a result of the action of the gas stream heated up in heat-exchanger 2*b*. This gas stream enriched with the desorbed HF—in this instance, the HF concentration is now as high as in the gas stream leaving the reactor 1*a* in the previous period in the first desorption step—is introduced through gas pipes 19*b*, 6*b*, 17*c*, the heat-exchanger 3*c*, in which it is cooled if necessary, and the gas pipe 21*c* into reactor 1*c*. HF is sorbed by the substrate in the second step here. The gas stream depleted of HF is again conveyed to gas pump 4*b* through gas pipes 24*c*, 7*b* and 22*b* and so on.

The operating conditions are thus set up: in each case, one HF-inert gas circulation connects one reactor pair, of which one functions as a sorption reactor and the other as a desorption reactor. The HF liberated during desorption enriches the circulated gas stream with HF. During sorption, HF is again removed from the gas stream. The HF concentration in the two circulations is different and is in fact higher in the circulation which combines a first desorption step with a second sorption step than in the circulation which combines a second desorption step with a first sorption step.

At the end of the fourth period, all the valves shown in FIG. 5 are closed and the gas pumps 4*a* and 4*b* are switched off. Reactor 1*a* is emptied of the substrate which has now been digested and is almost free of HF and is again filled with fresh substrate at the start of the next period, the first operating period.

Figure 2:
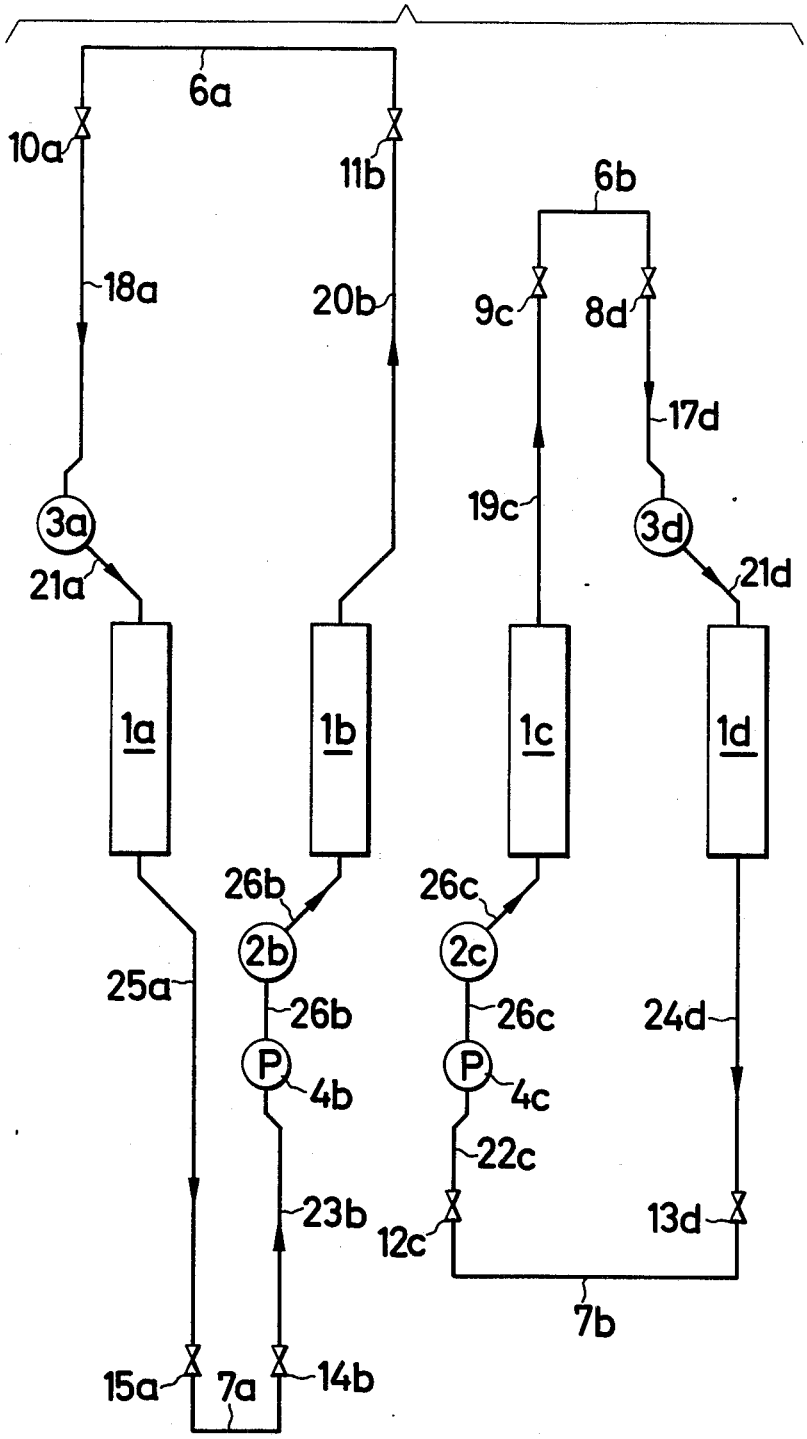
FIG. 2 shows the flow diagram in period 1 for the plan of FIG. 1.

By opening the valves shown in FIG. 2 and switching on the gas pumps 4*b* and 4*c*, the first sorption step in reactor 1*a* is connected with the second desorption step in reactor 1*b* and the first desorption step in reactor 1*c* is connected with the second sorption step in reactor 1*d* by HF-inert gas circulations. At the end of this period, all the valves shown in FIG. 2 are closed, gas pumps 4*b* and 4*c* are switched off, reactor 1*d* is emptied of substrate which has been digested and again filled with fresh substrate at the start of the second operating period.

Figure 3:
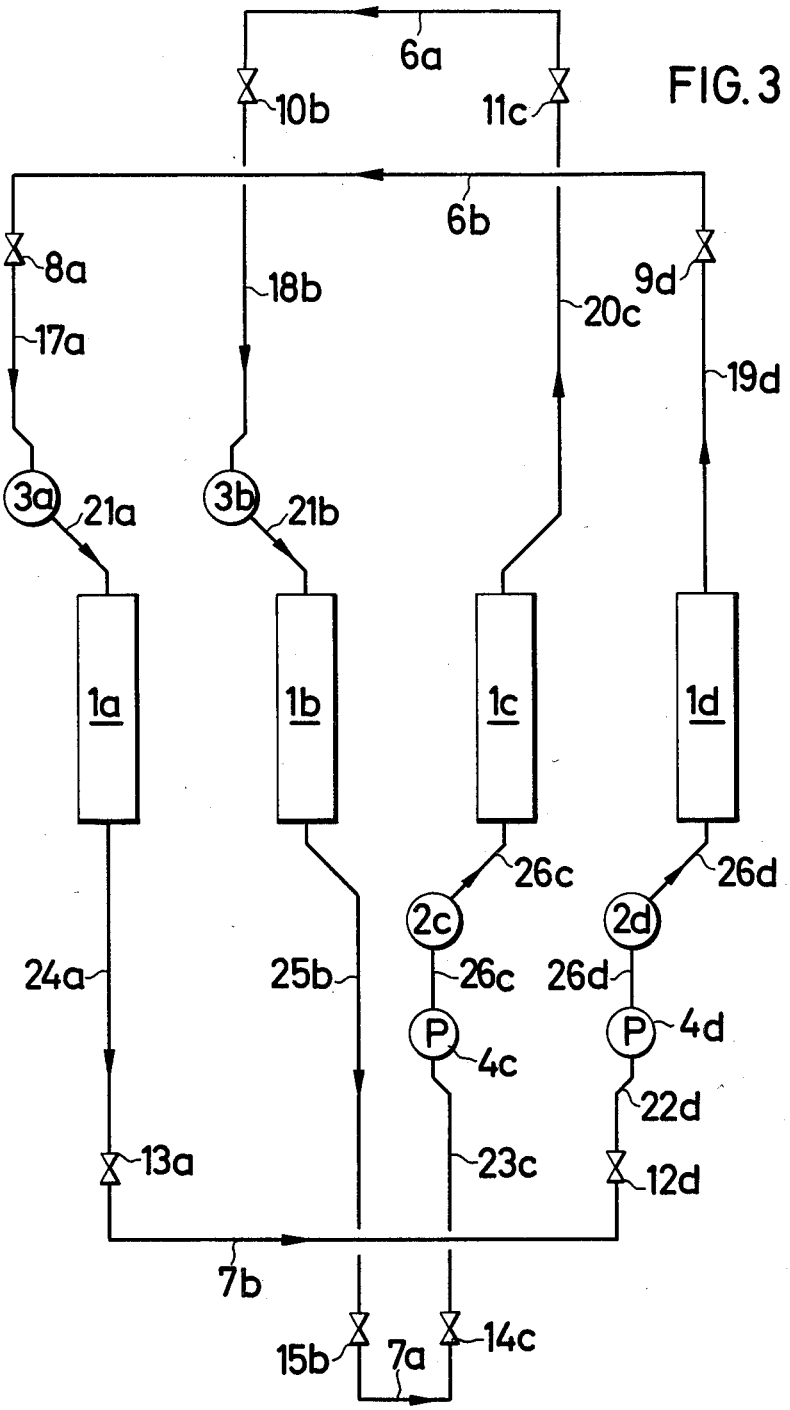
FIG. 3 shows the flow diagram in period 2 for the plan of FIG. 1.

By opening the valves shown in FIG. 3 and switching on gas pumps 4*c* and 4*d*, the second sorption step in reactor 1*a* is connected with the first desorption step in reactor 1*d* and the first sorption step in reactor 1*d* is connected with the second desorption step in reactor 1*c* by HF-inert gas circulations. At the end of this period, all the valves shown in FIG. 3 are closed, gas pumps 4*c* and 4*d* are switched off, reactor 1*c* is emptied of substrate which has been digested and is again filled with fresh substrate at the start of the third operating period.

Figure 4:
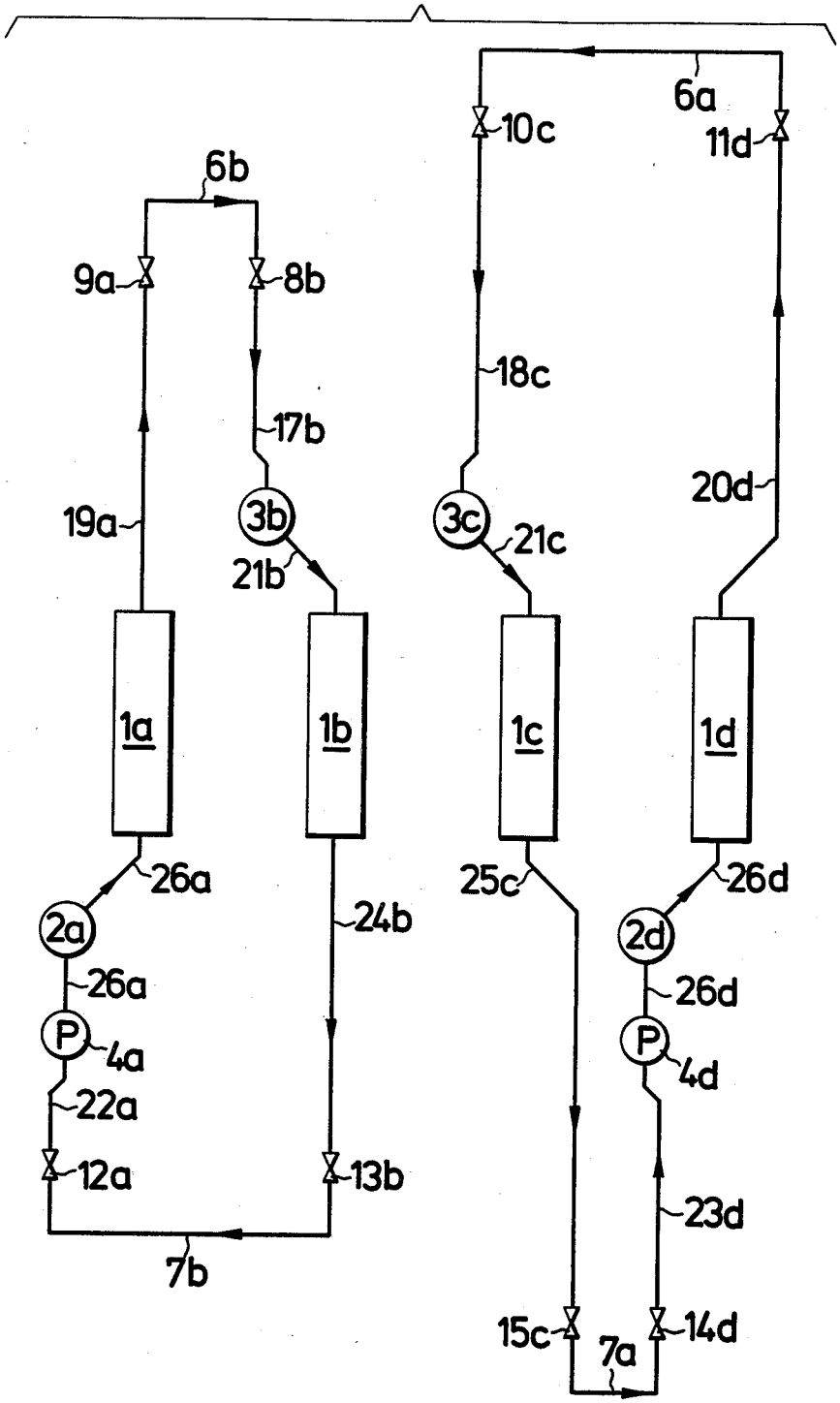
FIG. 4 shows the flow diagram in period 3 for the plan of FIG. 1.

By opening the valves shown in FIG. 4 and switching on the gas pumps 4*a* and 4*d*, the first desorption step in reactor 1*a* is connected with the second sorption step in reactor 1*d* and the first sorption step in reactor 1*c* is connected with the second desorption step in reactor 1*d* by HF-inert gas circulations. At the end of this period, all valves shown in FIG. 4 are closed, gas pumps 4*a* and 4*d* are switched off, reactor 1*d* is emptied of substrate which has been digested and is again filled with fresh substrate at the start of the fourth operating period.

By opening the valves shown in FIG. 5 and switching on gas pumps 4*a* and 4*b*, the second desorption step in reactor 1*a* is connected with the first sorption step in reactor 1*d* and the second sorption step in reactor 1*c* is connected with the first desorption step in reactor 1*d* by HF-inert gas circulations. At the end of this period, all the valves shown in FIG. 5 are closed, gas pumps 4*a* and 4*b* are switched off, reactor 1*a* is emptied of the substrate which has been digested and is again filled with fresh substrate at the start of the next period.

A new period cycle starts with this next period, starting with the filling of reactor 1*a* and ending with its emptying after four periods have taken place. The procedures described above are repeated again for each cycle.

The batches of digested substrate always contain small amounts of HF. The HF losses in the gas circulations caused thereby are replaced from time to time by briefly opening valve 5*b* and allowing HF to flow into a gas circulation which connects a second sorption step with a first desorption step.

The table summarizes which step takes place in a particular reactor in a certain time segment (period) (operating conditions) and between which reactors there are HF-inert gas circulations for carrying out the process according to the invention in 6 steps in 6 reactors (n=6).

In this table:

Operating conditions (step) S1: first sorption step

Operating conditions (step) S2: second sorption step

Operating conditions (step) S3: third sorption step

Operating conditions (step) D1: first desorption step

Operating conditions (step) D2: second desorption step

Operating conditions (step) D3: third desorption step

F: filling the reactor with fresh substrate

E: empyting the reactor of digested substrate.

O denotes that the required HF-inert gas mixture of low, moderate of high concentration is produced externally and fed into the reactor. After sorption of HF, the excess amounts of HF still present in the particular waste gas are removed with water or potassium hydroxide solution in a wash column.

The first sorption steps, at the start of which in each case the reactor is filled with fresh substrate (FS1) and the last (third) desorption steps, at the end of which the particular reactor is emptied of digested substrate (D3E), are specially marked in the table.

TABLE

| Phase | Period | Reactor | 1 | 2 | 3 | 4 | 5 | 6 |
|---|---|---|---|---|---|---|---|---|
| Start-up | 1 | Operating conditions | FS1 | | | | | |
| | | Gas circulation with reactor | 0 | | | | | |
| | 2 | Operating conditions | S2 | FS1 | | | | |
| | | Gas circulation with reactor | 0 | 0 | | | | |
| | 3 | Operating conditions | S3 | S2 | FS1 | | | |
| | | Gas circulation with reactor | 0 | 0 | 0 | | | |
| | 4 | Operating conditions | D1 | S3 | S2 | FS1 | | |
| | | Gas circulation with reactor | 2 | 1 | 0 | 0 | | |
| | 5 | Operating conditions | D2 | D1 | S3 | S2 | FS1 | |
| | | Gas circulation with reactor | 4 | 3 | 2 | 1 | 0 | |
| | 6 | Operating conditions | D3E | D2 | D1 | S3 | S2 | FS1 |
| | | Gas circulation with reactor | 6 | 5 | 4 | 3 | 2 | 1 |
| Operating | 1 | Operating conditions | FS1 | D3E | D2 | D1 | S3 | S2 |
| | | Gas circulation with reactor | 2 | 1 | 6 | 5 | 4 | 3 |
| | 2 | Operating conditions | S2 | FS1 | D3E | D2 | D1 | S3 |
| | | Gas circulation with reactor | 4 | 3 | 2 | 1 | 6 | 5 |
| | 3 | Operating conditions | S3 | S2 | FS1 | D3E | D2 | D1 |
| | | Gas circulation with reactor | 6 | 5 | 4 | 3 | 2 | 1 |
| | 4 | Operating conditions | D1 | S3 | S2 | FS1 | D3E | D2 |
| | | Gas circulation with reactor | 2 | 1 | 6 | 5 | 4 | 3 |
| | 5 | Operating conditions | D2 | D1 | S3 | S2 | FS1 | D3E |
| | | Gas circulation with reactor | 4 | 3 | 2 | 1 | 6 | 5 |
| | 6 | Operating conditions | D3E | D2 | D1 | S3 | S2 | FS1 |
| | | Gas circulation with reactor | 6 | 5 | 4 | 3 | 2 | 1 |

The material prepared by digestion in the process according to the invention is a mixture of lignin and oligomeric saccharides. It can be worked up in a manner known per se by extraction with water, advantageously at an elevated temperature or at the boiling point, with simultaneous or subsequent neutralization, for example with lime. Filtration provides lignin which, for example, can be used as a fuel, as well as a small amount of calcium fluoride which originates from the small amounts of residual hydrogen fluoride present in the material from the reaction. The filtrate which is a clear pale yellowish saccharide solution, can either by passed directly, or after adjustment to an advantageous concentration, for alcoholic fermentation or enzyme action. The dissolved oligomeric saccharides can also be converted almost quantitatively to glucose by a brief aftertreatment, for example with very dilute mineral acid at temperatures above 100° C.

The process according to the invention combines the advantages of a continuous and a discontinuous manner of proceeding. If the overall system composed of several reactors is considered, the material flow occurs in batches, the intervals in time between which correspond to the duration of a sorption or desorption period. Each reactor is filled with fresh raw material at the start of a reaction sequence; thereafter, the material to be reacted always has a uniform dwell time, which can be exactly defined and which accelerates the procedure greatly and increases the yield. The devices for transporting material containing HF which are necessary for a continuous mode of operation and which are technically elaborate and expensive because of the requirement for gas-tightness are unnecessary. At the end of the reaction sequence, the digested material is removed from the reactor. The reactor can then, if desired, be briefly inspected and cleaned or replaced by another before being charged with new raw material. The last-mentioned advantage of the process according to the invention is of particularly great importance, since all the raw materials to be employed contain certain proportions of dust which tend to stick together in contact with HF and can interfere with the functioning of reactors after a time. An additional advantage which should be finally emphasized is that in order to control the procedures during the course of the process, only gaseous media need be moved using valves and pumps.

EXAMPLES

Example 1

Equipment as shown schematically in FIG. 1 was used. 4 horizontally arranged drum reactors, each of 2 liters volume, served as reactors. The digestion of the substrate batches, which each comprised 200 g of granulated lignocellulose, i.e. the residue of a preliminary hydrolysis of spruce-wood having a water content of about 3% by weight, was carried out in 4 steps, 2 sorption and 2 desorption steps in cycles of 4 time segments (periods), each of 40 minutes, as is described above in more detail by means of FIGS. 2 to 5.

The temperature in the two sorption steps was 30° to 40° C., in the first desorption step was 60° to 70° C. and in the second desorption step was 80° to 90° C.

The concentration of HF on the substrate at the end of the first sorption step was about 30% by weight, was about 60% by weight at the end of the second sorption step, and was again about 30% by weight at the end of the first desorption step, in each case relative to the substrate containing no HF. The digested substrate obtained at the end of each 4th step still contained about 1 to 1.5% by weight of HF.

The HF concentrations in the HF-air mixtures (air was used as the inert gas) circulated were as follows:

On entry into the first sorption step (and correspondingly on leaving the second desorption step) at the start of the period about 55% by weight and at its end about 5% by weight. On entry into the second sorption step (and correspondingly on leaving the first desorption step) at the start of the period about 95% by weight and at its end about 45% by weight.

The digested material being produced in batches by emptying the reactors at the end of each second desorption step was conveyed to a continuous work-up. Wood sugar was obtained after extraction with hot water, neutralization with lime, filtration and evaporation. The yield was 90 to 92%, which fluctuated from batch to batch, relative to the amount of the cellulose contained in the substrate.

Example 2

The equipment used was analogous to that as is shown schematically in FIG. 1, with two further reactors and the additional gas pipes, valves, gas pumps and heat-exchangers necessary for them.

As in Example 1, horizontally arranged drum reactors, each of 2 liters volume, served as reactors. Batches, each of 200 g, of the granulated lignocellulose used in Example 1 were employed.

Digestion was carried out in 6 steps, 3 sorption and 3 desorption steps in cycles of 6 time segments (periods), each of 20 minutes.

In the individual steps (for the significance of the abbreviations, see the key to the table above), the following conditions were maintained:

S1: The HF-air mixture (air was used as the inert gas) entering the reactor had an HF concentration of about 30% by weight at the start of the period and a concentration of about 5% by weight at the end. The temperature was about 30° C. At the end of the period, the substrate contained about 5% by weight of HF relative to the substrate containing no HF.

S2: The HF concentration in the gas stream entering the reactor was about 60% by weight at the start and about 15% by weight at the end of the period. The temperature was 40° to 45° C. At the end of the period, the substrate had an HF concentration of about 30% by weight relative to the substrate containing no HF.

S3: The HF concentration in the gas stream entering the reactor was about 95% by weight at the start and about 45% by weight at the end of the period. The temperature was 35° to 40° C. At the end of the period, the substrate had an HF concentration of about 60% by weight relative to the substrate containing no HF.

D1: The temperature was about 60° C. At the end of the period, the substrate had an HF concentration of about 30% by weight relative to the substrate containing no HF. The HF-air mixture leaving the reactor had an HF concentration of about 95% by weight at the start of the period and at the end a concentration of about 45% by weight.

D2: The temperature was about 70° C. At the end of the period, the substrate had an HF concentration of about 5% by weight relative to the substrate containing no HF. The HF-air mixture leaving the reactor had an HF concentration of about 60% by weight at the start of the period and a concentration of about 15% by weight at its end.

D3: The temperature was about 80° C. At the end of the period, the substrate, which was now digested, had a slight residual concentration of 0.5 to 1.0% by weight, which varied from batch to batch. The HF-air mixture leaving the reactor had an HF concentration of about 30% by weight at the start of the period and a concentration of about 5% by weight at its end.

The digested material produced in batches on emptying the reactors at the end of each third desorption step was worked up as described in Example 1. The yield was 93 to 95%, fluctuating from batch to batch, relative to the amount of cellulose contained in the substrate.

The HF losses in the 3 gas circulations caused by the small HF content of the digested and removed substrate were replaced by introducing the deficient amount of HF in the form of a gas from an HF vaporizer into the gas circulation existing between a 3rd sorption and a first desorption step.

We claim:

1. A semi-continuous process for hydrolyzing cellulose-containing material with gaseous hydrogen fluoride by sorption of HF and subsequent desorption, which comprises, for n batches of said material, carrying out said sorption and desorption in n steps in n reactors, each step independent from each other with respect to each said batch of said material, said n steps being carried out on each said batch of material as follows:

initially, sorption in the first to (n/2)th step, by the action of HF-inert gas mixtures following through said material, said sorption step being carried out at temperatures above the boiling point of hydrogen fluoride so that the thus-sorbed fluid is always a gas mixture, the HF concentration of the HF-inert gas mixtures having HF concentrations which increase from sorption step to sorption step, then desorption in the ((n/2)+1) to nth step, by treatment with heated HF-inert gas mixtures passing through said material, said mixtures having HF concentrations which decrease from desorption step to desorption step;

wherein n is an even number from 4 to 12 and wherein the n steps take place simultaneously in different reactors but in the same reactor for each batch of material in identical time periods and wherein the sequence of steps from batch to batch is each displaced by one said time period and wherein, during each period, the batch undergoing the first step is in HF-inert gas-circulating communication with the batch undergoing the nth step and the batch undergoing the second step is in HF-inert gas-circulating communication with the batch undergoing the penultimate (n−1)th step, and any remaining batches through the (n/2)th step are in HF-inert gas circulating communication with the respective batches through the ((n/2)+1)th step.

2. The process as claimed in claim 1, wherein air or nitrogen is used as the inert gas.

3. The process as claimed in claim 1, wherein n is an even number from 4 to 8.

4. The process as claimed in claim 1, wherein a preliminary hydrolyzate of wood or waste from annual plants or waste paper is employed as the cellulose-containing material.

5. The process as claimed in claim 4, wherein air or nitrogen is used as the inert gas.

6. The process as claimed in claim 4, wherein n is an even number from 4 to 8.

* * * * *